US011445808B1

(12) United States Patent
Wind

(10) Patent No.: US 11,445,808 B1
(45) Date of Patent: Sep. 20, 2022

(54) BEVERAGE CONTAINER WITH SWIVEL JOINT

(71) Applicant: Thys J. Wind, Raleigh, NC (US)

(72) Inventor: Thys J. Wind, Raleigh, NC (US)

( * ) Notice: Subject to any disclaimer, the term of this patent is extended or adjusted under 35 U.S.C. 154(b) by 271 days.

(21) Appl. No.: 16/858,017

(22) Filed: Apr. 24, 2020

(51) Int. Cl.
*A45F 5/10* (2006.01)
*B65D 1/04* (2006.01)

(52) U.S. Cl.
CPC ..... *A45F 5/10* (2013.01); *B65D 1/04* (2013.01); *A45F 2200/0583* (2013.01)

(58) Field of Classification Search
CPC ..... A45F 5/10; A45F 2200/0583; B65D 1/04
USPC ..... 224/101, 148.1, 148.4–148.7
See application file for complete search history.

(56) References Cited

U.S. PATENT DOCUMENTS 178,818 A * 6/1876 Warner ..... B65D 47/248 D7/596
2,110,237 A * 3/1938 Parsons ..... G01N 33/04 285/911
2,833,436 A * 5/1958 Ruderian ..... A47J 41/02 206/217
3,180,537 A * 4/1965 Collins ..... B65D 83/06 206/821
3,327,881 A 6/1967 Maier
3,371,807 A * 3/1968 Clouser ..... A47J 41/02 215/398
3,465,905 A * 9/1969 Schottanes ..... A47J 41/02 215/6
3,485,416 A * 12/1969 Fohrman ..... A47G 19/24 D9/503
4,220,302 A * 9/1980 Hampton ..... A61J 9/0676 248/102
4,433,801 A * 2/1984 Swinney ..... B44D 3/14 224/268
4,444,324 A * 4/1984 Grenell ..... B65D 25/04 426/115
4,603,784 A * 8/1986 Chang ..... A61J 9/008 215/11.1
4,703,871 A 11/1987 Broker
4,773,563 A 9/1988 Taylor
4,832,231 A 5/1989 Kolody
4,881,652 A 11/1989 Schiemann
4,901,630 A 2/1990 Hall
4,984,715 A 1/1991 Green
5,040,709 A * 8/1991 Neugent ..... B62J 11/04 224/431
5,240,145 A 8/1993 Hogberg
5,279,841 A * 1/1994 Yu ..... B65D 71/502 206/821
5,294,028 A * 3/1994 Bankroff ..... A45F 3/16 220/669
5,499,738 A * 3/1996 Burleigh ..... B65D 1/04 220/602
5,630,523 A * 5/1997 Wright ..... B65D 21/0231 220/4.27

(Continued)

*Primary Examiner* — Peter N Helvey
(74) *Attorney, Agent, or Firm* — Cramer Patent & Design, PLLC; Aaron R. Cramer

(57) ABSTRACT

A beverage container includes two (2) fluid reservoirs that are capable of being coupled together. A cap for each container faces outward and includes a one-way valve. A connector ring is captured by the coupled reservoirs and is capable of removable connection to a swivel unit, permitting a user to rotate the container to access a desired reservoir while retaining the same in hand.

17 Claims, 7 Drawing Sheets

(56) References Cited

U.S. PATENT DOCUMENTS

| | | | | |
|---|---|---|---|---|
| 5,722,574 | A * | 3/1998 | Pratt | A45F 5/00 224/660 |
| 6,105,812 | A | 8/2000 | Riordan | |
| 6,135,323 | A | 10/2000 | Chen et al. | |
| 6,196,412 | B1 * | 3/2001 | Cattell | B65D 25/04 220/254.2 |
| 6,237,800 | B1 * | 5/2001 | Barrett | A45F 3/16 215/312 |
| 6,250,346 | B1 | 6/2001 | Castillo | |
| 6,439,416 | B1 | 8/2002 | Hawkins | |
| 6,913,777 | B2 | 7/2005 | Rebhorn et al. | |
| 7,571,829 | B2 | 8/2009 | Gersovitz | |
| 8,424,713 | B2 * | 4/2013 | Bolland | A47G 23/0266 220/741 |
| 8,915,395 | B2 * | 12/2014 | Gersovitz | B65D 21/0224 220/524 |
| 8,919,622 | B1 * | 12/2014 | Gabriel | A45F 5/021 224/159 |
| 8,919,623 | B1 * | 12/2014 | Bergeron | A45F 5/02 224/159 |
| 2004/0159625 | A1 * | 8/2004 | Kwon | B65D 55/0818 215/334 |
| 2005/0258204 | A1 * | 11/2005 | Evans | A45F 5/02 224/269 |
| 2006/0249472 | A1 | 11/2006 | Kullson et al. | |
| 2007/0221603 | A1 * | 9/2007 | Moss | A61J 9/00 215/11.1 |
| 2008/0110899 | A1 | 5/2008 | Gustafson | |
| 2010/0294816 | A1 * | 11/2010 | Sentell | A45F 5/02 224/148.3 |
| 2019/0281964 | A1 * | 9/2019 | Britt | G06F 1/1628 |

* cited by examiner

BEVERAGE CONTAINER WITH SWIVEL JOINT

RELATED APPLICATIONS

None.

FIELD OF THE INVENTION

The present invention relates generally to a beverage container and more specifically to a beverage container having a swivel joint.

BACKGROUND OF THE INVENTION

Many people carry a bottle of water with them while exercising or when simply going about tasks throughout the day. While water is certainly healthy and refreshing to drink, many others enjoy the taste of tea, lemonade, juices, sports drinks, and the like as well. This forces the user to carry two bottles with them as they go about their daily lives at school, work, while exercising, or simply walking.

While certainly doable, keeping track and holding two different bottles quickly becomes a chore. Should one want to drink from one bottle, he or she must find a place to set the other bottle while the cap is unscrewed. The constant handling and shuffling of multiple bottles not only become a hassle, but it is difficult and time-consuming to do, especially when in a mobile state. Accordingly, there exists a need for a means by which mobile users can transport and drink two different beverages without the disadvantages as described above. The development of the beverage container with swivel joint fulfills this need.

SUMMARY OF THE INVENTION

It is therefore an object of the present invention to provide a dual-chambered drinking device, comprising a first-side bottle, a second-side bottle and a connector ring having an open loop through which the first-side bottle and the second-side bottle are removably coupled and remain held in place. The connector ring includes a round platform on an outer edge, along with a grommet and a lock pin extending outwardly. The drinking device also comprises a swivel unit which includes a swivel unit platform, a strap, a handle, and a strap adjuster. The swivel unit platform is retained between the round platform and the grommet, thereby holding the swivel unit platform in a parallel position with respect to the first-side bottle and the second-side bottle while coupled together and a pair of caps including a first-side bottle cap and a second-side bottle cap. The first-side bottle cap covers the first-side bottle and the second-side bottle cap covers the second-side bottle.

The first-side bottle may include a cap connector which allows the first-side bottle cap with the one-way valve to couple together with the first-side bottle in a twisting screw-type manner. The second-side bottle includes a cap connector to allow the second-side bottle cap with the one-way valve to couple together with the second-side bottle in a twisting screw-type manner. The connector ring provides a harness that may receive the coupled female-side bottle and the male-side bottle and carries the dual-chambered drinking device. The connector ring may give support to hold the handle of the swivel unit while permitting the coupled female-side bottle and the male-side bottle to rotate.

The handle includes a comfort outer wrap. The comfort outer wrap may be made of neoprene foam. The round platform, the grommet, and the lock pin may all circular and spaced apart by a narrow portion to receive the swivel unit platform. The lock pin may hold the grommet in place against the swivel unit platform, while allowing the swivel unit platform to freely rotate orthogonally about the connector ring exterior surface.

The swivel unit platform may be held in place and the swivel unit is permitted to freely rotate about the connector ring. The strap may be connected to the swivel unit platform and then routed through the handle for coupling with the strap adjuster. A pair of swivel platform first side slots may be located adjacent a terminal end of a first side of the swivel unit platform, as well as a pair of swivel platform second side slots located adjacent a terminal end of a second side of the swivel unit platform. The slots may be disposed parallel to the short sides of the swivel unit platform and have a width enabling passage of a portion of the strap.

A swivel platform aperture may be sized to permit the passage of the lock pin such that the connector ring is coupled to the swivel unit. The swivel unit platform may be made of rigid polypropylene. The swivel unit platform may be six-and-a-half inches long by one-and-a-half inches wide. The strap may be made three-quarter inch nylon webbing. The first-side bottle cap and the second-side bottle cap may include a screw-type fastener. The first-side bottle cap and the second-side bottle cap may also include a one-way valve. The first-side bottle may include a first-side bottle connector which is embedded within its bottom end and the second-side bottle which include a second-side bottle connector which is embedded within its bottom end and the first-side bottle connector mates with the second-side bottle connector.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
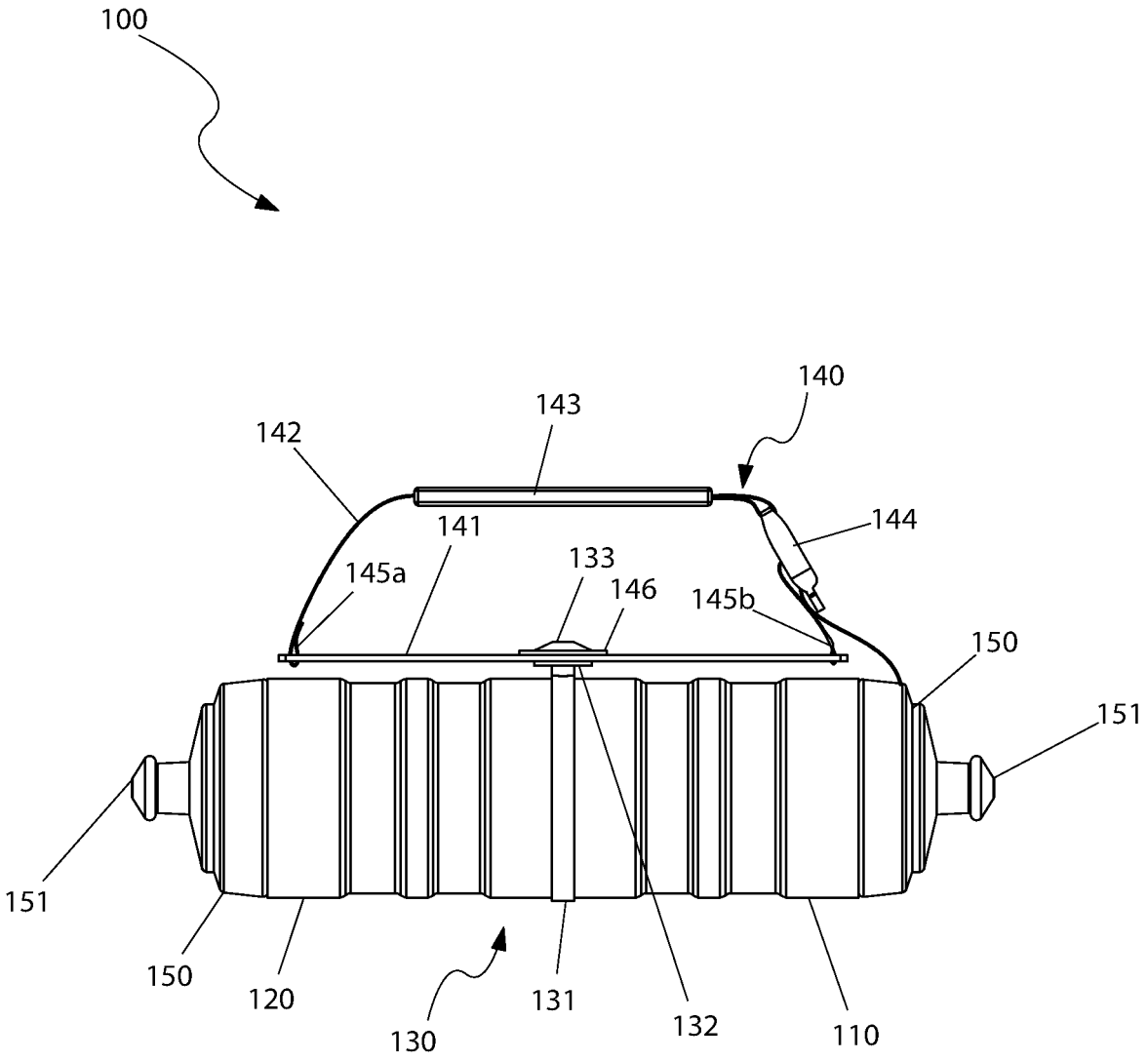
FIG. 1 is a side view of the dual-chambered drinking device, according to the preferred embodiment of the present invention.

100 dual-chambered drinking device
110 female-side bottle
115 female-side bottle connector
120 male-side bottle
125 male-side bottle connector
130 connector ring
131 round platform
132 grommet
133 lock pin
140 swivel unit
141 swivel unit platform
142 strap
143 handle
144 strap adjuster
145*a* swivel platform first side slot
145*b* swivel platform second side slot
146 swivel platform aperture
150 cap
151 one-way valve
152 cap connector

DESCRIPTION OF THE PREFERRED EMBODIMENTS

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side view of the dual-chambered drinking device 100, according to the preferred embodiment of the present invention is disclosed. This view illustrates the dual-chambered drinking device 100 including a female-side bottle 110, a male-side bottle 120, a connector ring 130, a swivel unit 140, and a plurality of caps 150 in a fully assembled configuration. The connector ring 130 may be configured as an open loop through which the female-side bottle 110 and male-side bottle 120 may removably couple and remain held in place. The connector ring 130 may include a round platform 131 on the outer edge, along with a grommet 132 and lock pin 133 extending outwardly therefrom. The swivel unit 140 may include a swivel unit platform 141, a strap 142, a handle 143, and a strap adjuster 144. The swivel unit platform 141 may be configured to be retained between the round platform 131 and grommet 132, thereby holding the swivel unit platform 141 in a generally parallel state with respect to the female-side bottle 110 and male-side bottle 120 while coupled together. The handle 142 may include a comfort outer wrap comprising neoprene foam or other suitable materials. The dual-chambered drinking device 100 may include a plurality of caps 150. More specifically, the device may include one (1) cap 150 for each of the female-side 110 and the male-side bottles 120. Each cap 150 may be configured internally with a screw-type fastener (not shown) and a one-way valve 151.

Figure 2:
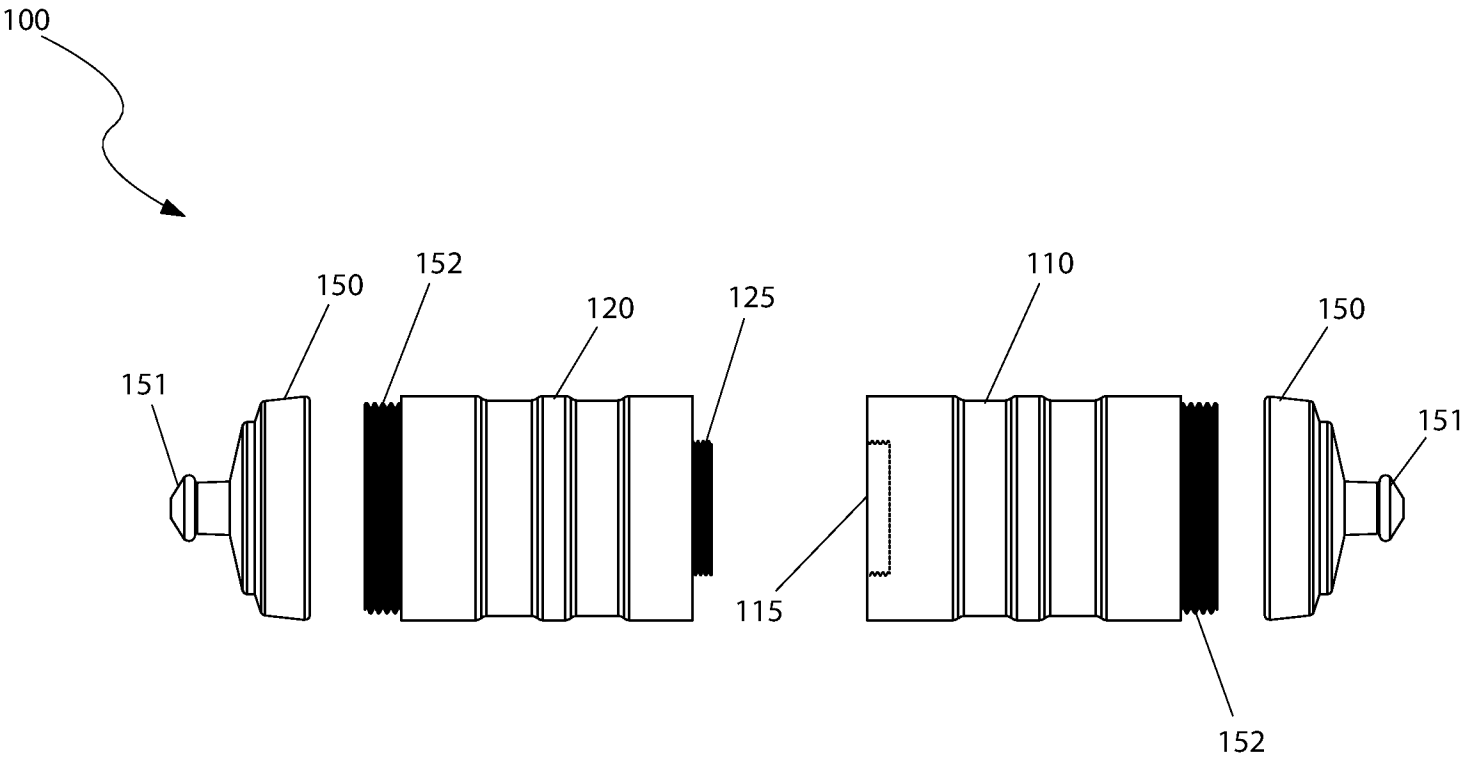
FIG. 2 is an exploded side view of the dual-chambered drinking device, according to the preferred embodiment of the present invention.

Referring next to FIG. 2, an exploded side view of the dual-chambered drinking device 100, according to the preferred embodiment of the present invention is depicted. This view clearly illustrates the female-side bottle 110 and the male-side bottle 120 in an uncoupled state with the respective caps 150 from each side also removed. The female-side bottle 110 includes a female-side bottle connector 115 embedded within its bottom end. The female-side bottle connector 115 may be configured as female screw threading for mating with a male-side bottle connector 125. The male-side bottle 120 includes a male-side bottle connector 125 embedded within its bottom end. The male-side bottle connector 125 includes male screw threading for coupling with the female-side bottle connector 115. Both the female-side bottle 110 and the male-side bottle 120 include a cap connector 152 at their respective upper ends. The cap connector 152 may be suitable for allowing the cap 150 with the one-way valve 151 to couple together with it in a twisting screw-type manner.

Figure 3:
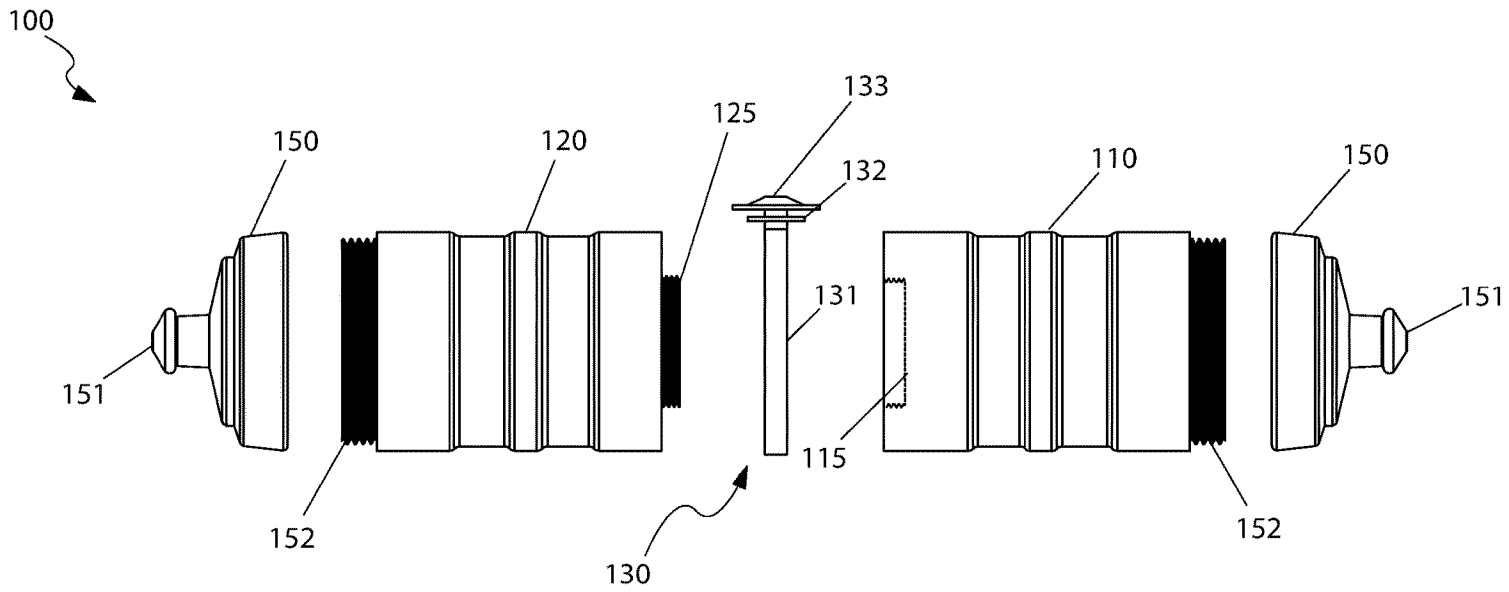
FIG. 3 is another exploded side view of the dual-chambered drinking device, illustrating the caps removed from the drinking bottles which are separated from each other and away from the connector ring, according to the preferred embodiment of the present invention.

Referring now to FIG. 3, another exploded side view of the dual-chambered drinking device 100, illustrating the caps 150 removed from the female-side bottle 110 and male-side bottle 120, which are separated from each other and away from the connector ring 130, according to the preferred embodiment of the present invention. Here again, this view clearly illustrates the female-side bottle 110 and the male-side bottle 120 in an uncoupled state with the respective caps 150 from each side also removed. The female-side bottle 110 includes a female-side bottle connector 115 embedded within its bottom end. The male-side bottle 120 includes a male-side bottle connector 125 embedded within its bottom end. The male-side bottle connector 125 include male screw threading for coupling with the female-side bottle connector 115 (not shown here; see FIG. 2). Both the female-side bottle 110 and the male-side bottle 120 include a cap connector 152 at their respective upper ends. The cap connector 152 may be suitable for allowing the cap 150 with the one-way valve 151 to couple together with it in a twisting screw-type manner. Also illustrated here is the connector ring 130 positioned between the female-side bottle 110 and male-side bottle 120. The connector ring 130 comprises a circular ring having a round platform 131, a grommet 132, and a lock pin 133. The connector ring 130 may be useful for providing a harness that is suitable for receiving the coupled female-side bottle 110 and male-side bottle 120 and carrying the entire device 100.

Figure 4:
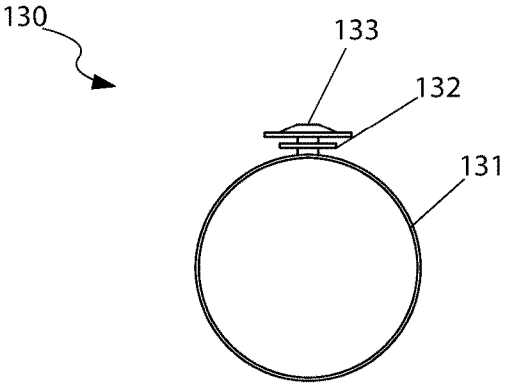
FIG. 4 is a front view of the connector ring of the dual-chambered drinking device, according to the preferred embodiment of the present invention.

Referring next to FIG. 4, a front view of the connector ring 130 of the dual-chambered drinking device 100, according to the preferred embodiment of the present invention is disclosed. This view illustrates the connector ring 130 in detail. As described before, the connector ring 130 comprises a ring-shaped harness, attached to which is a round platform 131, a grommet 132, and a lock pin 133. The round platform 131, grommet 132 and lock pin 133 are all circular in configuration and spaced apart by a narrow portion suited for receiving the swivel unit platform 141 (not shown here; see FIG. 1) therebetween. The lock pin 133 holds the grommet 132 in place against the swivel unit platform 141 (not shown), while still allowing the swivel unit platform 141 to freely rotate orthogonally about the connector ring 130 exterior surface. In a fully assembled state, the connector ring 130 gives support for a user to hold the handle 143 (not shown here) of the swivel unit 140 (also not shown) while permitting the coupled female-side bottle 110 (see FIG. 3) and male-side bottle 120 (see FIG. 3) to rotate while in possession of a user.

Figure 5:
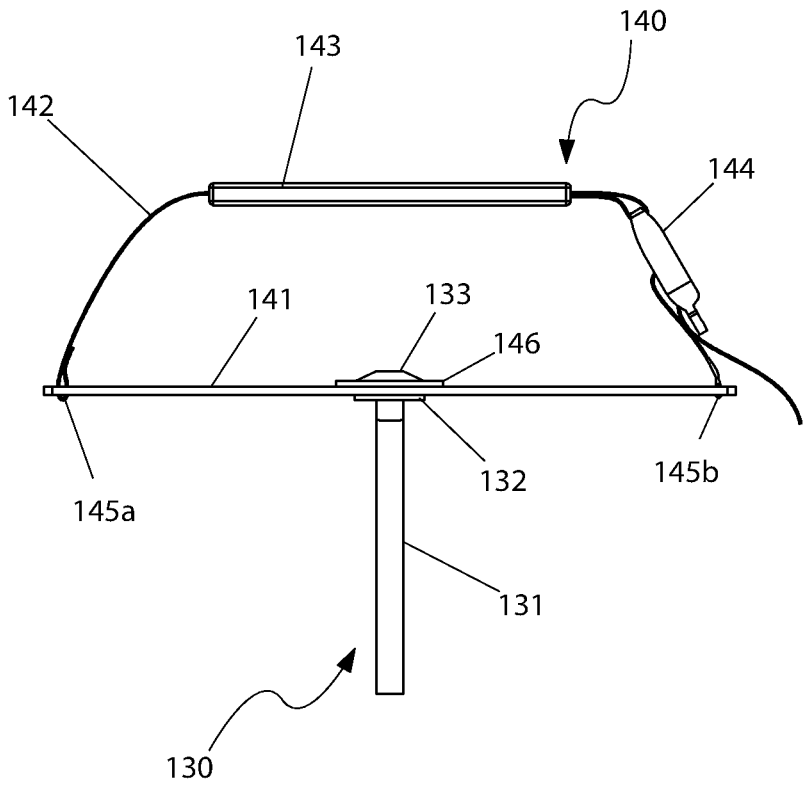
FIG. 5 is a side view of connector ring and swivel unit for the dual-chambered drinking device, according to the preferred embodiment of the present invention.

Referring next to FIG. 5 is a side view of the connector ring 130 and swivel unit 140 of the dual-chambered drinking device 100, according to the preferred embodiment of the present invention. This view illustrates the swivel unit 140 coupled to the connector ring 130 by means of the grommet 132 and lock pin 133. The lock pin 133 serves to hold the swivel unit platform 141 in place between the grommet 132 and round platform 131 of the connector ring 130. While the swivel unit platform 141 is held in place, the swivel unit 140 may still be permitted to freely rotate about the connector ring 130. The strap 142 is connected to the swivel unit platform 141 and then routed through the handle 143 for coupling with the strap adjuster 144. The strap adjuster 144 may comprise a one inch (1 in.) wide webbing adjuster that allows for selective tightening of the strap 142.

Figure 6:
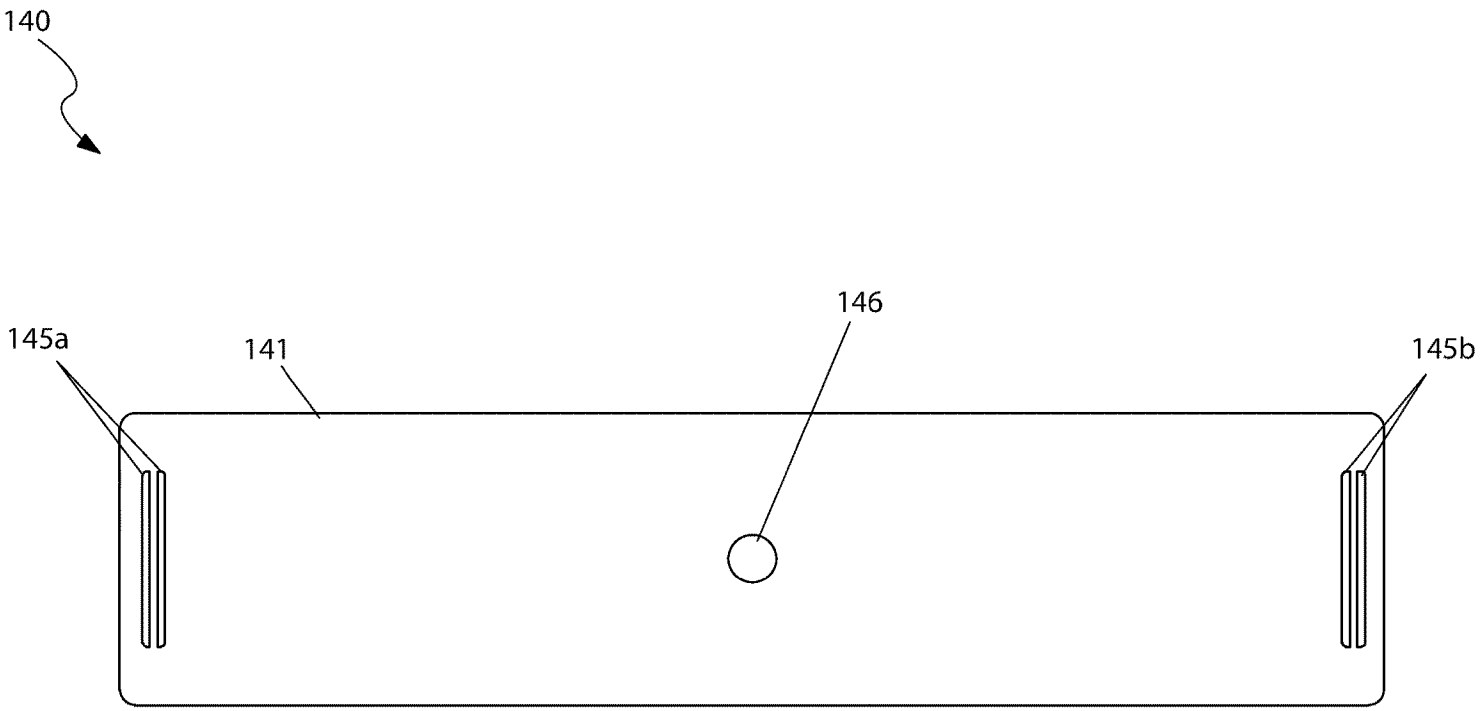
FIG. 6 is a top view of the swivel unit of the dual-chambered drinking device with the handle, strap, and connector ring removed, according to the preferred embodiment of the present invention.

Referring now to FIG. 6 is a bottom view of the swivel unit 140 of the dual-chambered drinking device 100 with the handle 143, strap 142, and the connector ring 130 removed. Here it is clearly shown that there are a pair of swivel platform first side slots 145*a* located adjacent a terminal end of a first side of the swivel unit platform 141, as well as a pair of swivel platform second side slots 145*b* located adjacent a terminal end of a second side of the swivel unit platform 141. The slots 145*a*, 145*b* are disposed parallel to the short sides of the swivel unit platform 141 and have a width capable of enabling passage of a portion of the strap 42 therethrough. Also shown, centrally-located on the swivel unit platform 141, is a swivel platform aperture 146. The swivel platform aperture 146 is sized to permit the passage of the lock pin 133 such that the connector ring 130 can be coupled to the swivel unit 140.

Figure 7:
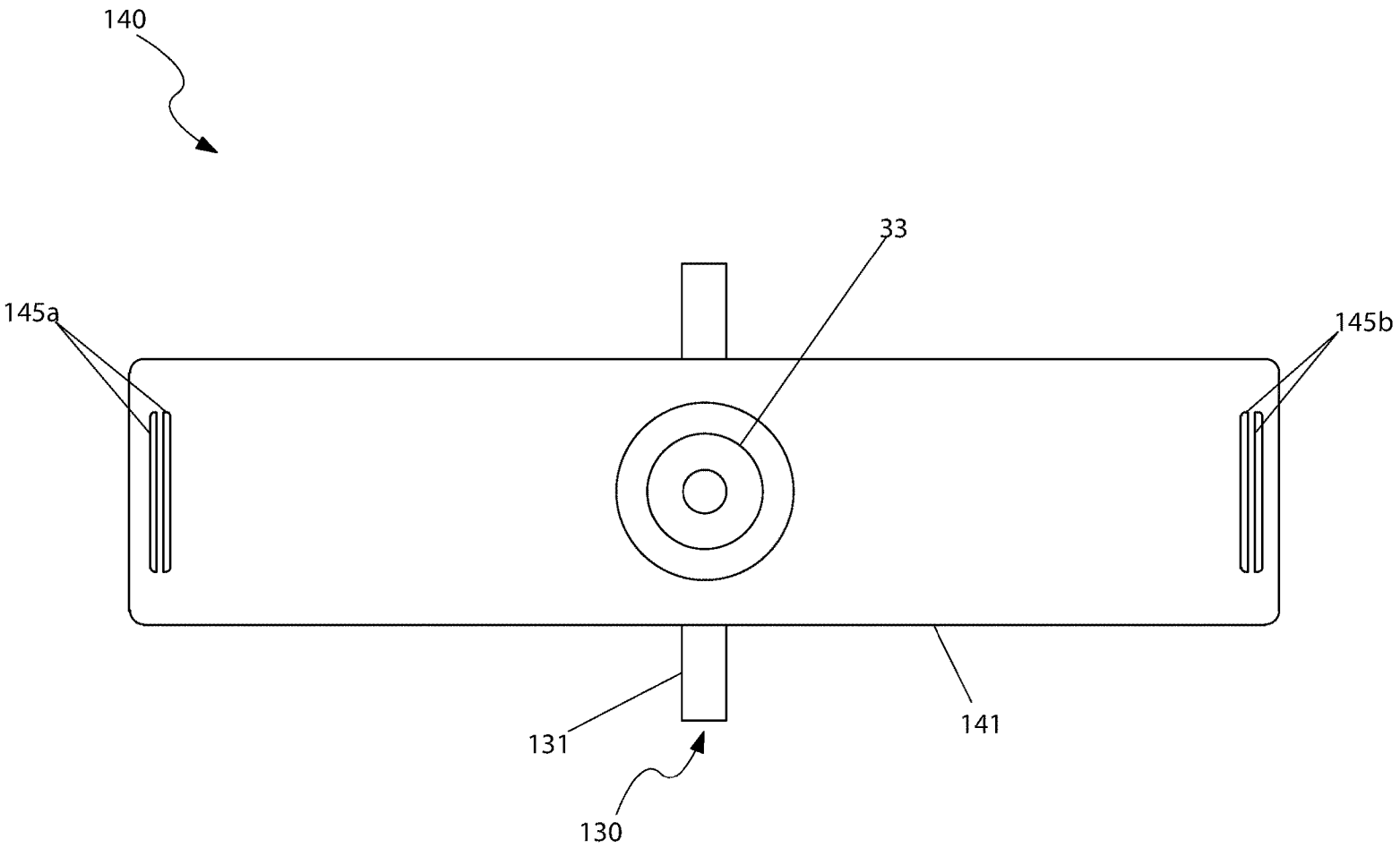
FIG. 7 is a top view of the swivel unit of the dual-chambered drinking device with the handle and strap removed and the connector ring attached, according to the preferred embodiment of the present invention; and, FIG. 8 is another top view of the dual-chambered drinking device, illustrating the swivel unit with strap, handle, and connector ring attached, according to the preferred embodiment of the present invention.

Referring next to FIG. 7 is a top view of the swivel unit 140 of the dual-chambered drinking device 100 with the handle 143 and strap 142 removed and the connector ring 130 attached, according to the preferred embodiment of the present invention. This view illustrates the swivel unit platform 141 as it is held in position about the connector ring 130. The swivel unit platform 141 may be retained beneath the grommet 132 and lock pin 133. The swivel unit platform 141 may comprise a rigid polypropylene platform measuring approximately six-and-a-half inches (6½ in.) long by one-and-a-half inches (6½ in.) wide.

Figure 8:
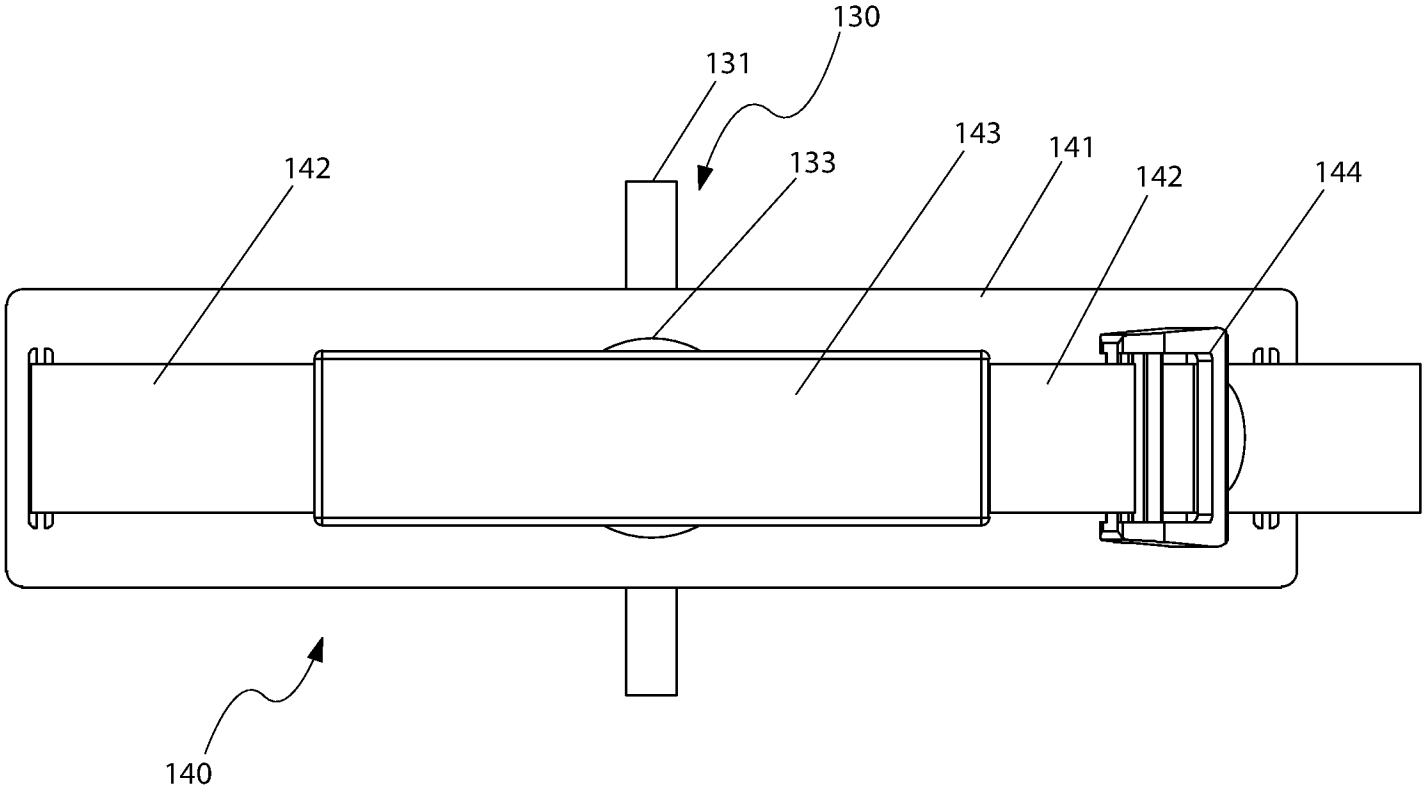

Referring now to FIG. 8, another top view of the dual-chambered drinking device 100, illustrating the swivel unit 140 with strap 142 and handle 143 attached, according to the preferred embodiment of the present invention is disclosed. This view shows the swivel unit 140 including the swivel unit platform 141 with strap 142, handle 143, and strap adjuster 144. The swivel unit 140 is attached to the connector ring 130 by a grommet 132 and lock pin 133 (not shown here; refer to FIG. 7). The grommet 132 may be constructed from brass or other durable materials. The strap 142 may comprise three-quarter inch (¾ in.) nylon webbing material. The strap 142 may feed through the handle 143 to the strap adjuster 144. The handle 143 may be configured as a water-resistant closed cell neoprene foam sleeve to help provide comfort and protect the back of a user's hand.

2. Operation of the Preferred Embodiment

The preferred embodiment of the present invention can be utilized by the common user in a simple and effortless manner with little or no training. It is envisioned that the dual-chambered drinking device 100 would be constructed in general accordance with FIG. 1 through FIG. 8. The user would procure the dual-chambered drinking device 100 through normal procurement channels. Through such channels, the device 100 may be procured in a variety of colors and sizes, but the preferred embodiment may include options for gripping ridges or indentations on the bottles along with differing colors of said bottles on each device to help distinguish between differing fluids that may be simultaneously contained in the female-side bottle 100 and male-side bottle 120.

After procurement and prior to utilization, the dual-chambered drinking device 100 would be filled with a different choice of fluids in each side of the device 100. During utilization of the device 100, a user may simply rotate the device by twisting the bottle 110, 120 around the connector ring 130 in order to select a particular choice of stored fluid. This can be accomplished by rotating the coupled bottles 110,120 and connector ring 130 about the swivel unit 140. The choice fluid may then be expended from said bottle 110, 120 by squeezing the bottle 110, 120 and forcing the fluid through the one-way valve 151 of the cap 150. Alternatively, the user may disengage the female-side bottle 110 from the male-side bottle 120 by unscrewing the bottles 110, 120 in opposite directions. The female-side bottle 100 and male-side bottles 120 would then be independently usable outside of the connector ring 130.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A dual-chambered drinking device, comprising:

a first-side bottle;

a second-side bottle;

a connector ring having an open loop through which the first-side bottle and the second-side bottle are removably coupled and remain held in place, the connector ring includes a round platform on an outer edge, along with a grommet and a lock pin extending outwardly therefrom;

a swivel unit including a swivel unit platform, a strap, a handle, and a strap adjuster, the swivel unit platform is retained between the round platform and the grommet, thereby holding the swivel unit platform in a parallel position with respect to the first-side bottle and the second-side bottle while coupled together;

a pair of caps including a first-side bottle cap and a second-side bottle cap, the first-side bottle cap covers the first-side bottle and the second-side bottle cap covers the second-side bottle and, wherein the handle includes a comfort outer wrap;

wherein the comfort outer wrap is made of neoprene foam; and, wherein a pair of swivel platform first side slots are located adjacent a terminal end of a first side of the swivel unit platform, as well as a pair of swivel platform second side slots located adjacent a terminal end of a second side of the swivel unit platform.

2. The dual-chambered drinking device according to claim 1, wherein the first-side bottle includes a cap connector to allow the first-side bottle cap with a one-way valve to couple together with the first-side bottle in a twisting screw-type manner.

3. The dual-chambered drinking device according to claim 1, wherein the second-side bottle includes a cap connector to allow the second-side bottle cap with the one-way valve to couple together with the second-side bottle in a twisting screw-type manner.

4. The dual-chambered drinking device according to claim 1, wherein the connector ring provides a harness that receives a coupled female-side bottle and a male-side bottle and carries the dual-chambered drinking device.

5. The dual-chambered drinking device according to claim 4, wherein the connector ring gives support to hold the handle of the swivel unit while permitting the coupled female-side bottle and the male-side bottle to rotate.

6. The dual-chambered drinking device according to claim 1, wherein the round platform, the grommet, and the lock pin are all circular and spaced apart by a narrow portion to receive the swivel unit platform therebetween.

7. The dual-chambered drinking device according to claim 1, wherein the lock pin holds the grommet in place against the swivel unit platform, while allowing the swivel unit platform to freely rotate orthogonally about the connector ring exterior surface.

8. The dual-chambered drinking device according to claim 1, wherein the swivel unit platform is held in place and the swivel unit is permitted to freely rotate about the connector ring.

9. The dual-chambered drinking device according to claim 1, wherein the strap is connected to the swivel unit platform and then routed through the handle for coupling with the strap adjuster.

10. The dual-chambered drinking device according to claim 1, wherein at least two slots are disposed parallel to the short sides of the swivel unit platform and have a width enabling passage of a portion of the strap therethrough.

11. The dual-chambered drinking device according to claim 1, further comprising a swivel platform aperture is sized to permit the passage of the lock pin such that the connector ring is coupled to the swivel unit.

12. The dual-chambered drinking device according to claim 1, wherein the swivel unit platform is made of rigid polypropylene.

13. The dual-chambered drinking device according to claim 1, wherein the swivel unit platform is six-and-a-half inches long by one-and-a-half inches wide.

14. The dual-chambered drinking device according to claim 1, wherein the strap is made three-quarter inch nylon webbing.

15. The dual-chambered drinking device according to claim 1, wherein the first-side bottle cap and the second-side bottle cap includes a screw-type fastener.

16. The dual-chambered drinking device according to claim 1, wherein the first-side bottle cap and the second-side bottle cap includes a one-way valve.

17. The dual-chambered drinking device according to claim 1, wherein the first-side bottle includes a first-side bottle connector embedded within its bottom end and the second-side bottle includes a second-side bottle connector embedded within its bottom end and the first-side bottle connector mates with the second-side bottle connector.

* * * * *